US006819887B1

(12) United States Patent
Eom et al.

(10) Patent No.: US 6,819,887 B1
(45) Date of Patent: Nov. 16, 2004

(54) APPARATUS AND METHOD FOR MEASURING CONCENTRATION OF DEVELOPER IN LIQUID PRINTER

(75) Inventors: Yoon-seop Eom, Suwon (KR); Yong-baek Yoo, Suwon (KR); Seung-deog An, Yongin (KR); Jong-woo Kim, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 727 days.

(21) Appl. No.: 09/691,245

(22) Filed: Oct. 19, 2000

(30) Foreign Application Priority Data

Oct. 27, 1999 (KR) ..... 1999-46898

(51) Int. Cl.[7] ..... G03G 15/10
(52) U.S. Cl. ..... 399/57; 399/58; 399/62
(58) Field of Search ..... 399/24, 30, 57, 399/58, 62, 64, 65, 237, 239

(56) References Cited

FOREIGN PATENT DOCUMENTS

| | | |
|---|---|---|
| JP | 05332926 | 12/1993 |
| JP | 06109630 | 4/1994 |
| JP | 07044025 | 2/1995 |
| JP | 10268645 | 10/1998 |
| JP | 11143243 | 5/1999 |

OTHER PUBLICATIONS

Notification of Reason for Rejection Jul. 31, 2001 issues by Japanese Patent Office and English Translation.

*Primary Examiner*—Hoang Ngo
(74) *Attorney, Agent, or Firm*—Robert E. Bushnell, Esq.

(57) ABSTRACT

A developer concentration measuring apparatus of a liquid printer includes a container installed so that developer supplied to a photoreceptor web enters and is exhausted, a roller rotatably installed in the container for forming a film of the developer contained in the container on a surface thereof being exposed while rotating, a roller driving module for driving the roller to rotate at a predetermined speed, a light emitting module for emitting a predetermined amount of light to the surface of the roller where the film is formed, a light-receiving module, installed to detect light emitted from the light emitting module and passing through the film, for transmitting a signal corresponding to the amount of received light, a temperature detector for detecting the temperature of the developer contained in the container; and a concentration measuring module for measuring the concentration of the developer from information on temperature output from the temperature detector and from the signal output from the light-receiving module. Thus, by obtaining the information on the temperature of developer and measuring the concentration of the developer appropriate to the obtained temperature information, generation of concentration measurement errors is lowered.

21 Claims, 6 Drawing Sheets

APPARATUS AND METHOD FOR MEASURING CONCENTRATION OF DEVELOPER IN LIQUID PRINTER

CLAIM OF PRIORITY

This application makes reference to, incorporates the same herein, and claims all benefits accruing under 35 U.S.C. §119 from the inventor's application DEVELOPER DENSITY MEASURING APPARATUS FOR LIQUID PRINTER filed with the Korean Industrial Property Office on 27 Oct. 1999 and there duly go assigned Ser. No. 46898/1999.

BACKGROUND OF THE INVENTION

1. Field of the Invention

The present invention relates to an apparatus and method for measuring the concentration of developer solution in a liquid printer. More particularly, the invention relates to an apparatus and method for measuring the concentration of developer solution in a liquid printer which can prevent a concentration measuring error due to change of the temperature of the developer solution.

2. Description of the Related Art

A general liquid color image forming apparatus includes a photoreceptor web circulating by being supported by rollers, a reset unit, laser scanning units, development units, a drying unit and a transfer unit.

The reset unit includes a discharger for removing an electrostatic latent image by emitting light to the photoreceptor web and a charger for charging the photoreceptor web to a predetermined electric potential.

The four laser scanning units scan color information of yellow (Y), magenta (M), cyan (C) and black (K) onto the photoreceptor web. The four development units provide developers of yellow (Y), magenta (M), cyan (C) and black (K) to the photoreceptor web.

The development units include a developer supply container for supplying developer to the photoreceptor web and a development reservoir for collecting developer falling from the photoreceptor web. In the development reservoir, there are a development roller, a brush roller for removing developer adhering to the development roller, a squeegee roller for separating a liquid carrier component of the developer supplied to the photoreceptor web which is not used for forming an image, and a blade for collecting the carrier component flowing down along the squeegee roller.

The development supply container receives developer solution contained in the development reservoir, liquid carrier component N (norpor), which is solvent, provided from a developer supply module, and toner which is development material or highly concentrated developer. The developer solution contained in the developer supply container is driven by a pump and supplied between the development roller and the photoreceptor web.

To maintain the quality of an image in the above-described general liquid printer, concentration of the developer solution supplied to the photoreceptor web, that is, the ratio of a mixture of the toner and the liquid carrier, must be appropriately maintained.

A conventional developer concentration measuring apparatus includes a film forming module, a light source, a photodetector, a concentration measurement calculation means or module, a lookup table (LUT), and a roller-driving module.

The film forming module includes a container for containing developer solution, so that the developer solution is formed as a thin film having an appropriate thickness on a roller rotatably installed in the container. The roller-driving module rotates the roller at a constant speed. The photodetector is installed to receive light emitted from the light source and reflected off the film on the roller. The concentration-calculation module contains a means for calculating a concentration of the developer solution on the basis of a signal output p from the photodetector, which is typically done from the lookup table.

However, the inventors have found that, when the temperature of the developer solution contained in the container varies due to change of the temperature of surroundings, the signal output from the photodetector changes. The inventors have found that this change occurs because, as the viscosity of the developer solution changes according to the change of the temperature, the thickness of the film formed on the roller rotating at a constant speed varies. Thus, the conventional developer concentration measuring apparatus has a drawback, in that an error is generated in measuring the concentration of developer solution due to the foregoing change of temperature of developer.

SUMMARY OF THE INVENTION

To solve the above problem, it is an object of the present invention to provide an apparatus for measuring the concentration of developer solution in a liquid printer, which can accurately measure the concentration of developer by obtaining and utilizing information on the temperature of the developer.

Accordingly, to achieve the above object, there is provided a developer concentration measuring apparatus for a liquid printer, which comprises a container installed so that developer supplied to a photoreceptor web enters and is exhausted, a roller rotatably installed in the container for forming a film of the developer contained in the container on a surface thereof being exposed while rotating, a roller driving module for driving the roller to rotate at a predetermined speed, a light emitting module for emitting a predetermined amount of light to the surface of the roller where the film is formed, a light-receiving module, installed to detect light emitted from the light emitting module and passing through the film, for transmitting a photodetector signal p corresponding to the amount of received light, an additional sensor in the form of a temperature detector for detecting the temperature T of the developer contained in the container; and an improved concentration measuring module or means for measuring the concentration of the developer from information on temperature output is signal from the temperature detector and from the photodetector signal output from the light-receiving module.

Also, to achieve the above object, there is provided a developer solution concentration measuring apparatus which comprises a container installed so that developer supplied to a photoreceptor web enters and is exhausted, a roller rotatably installed in the container for forming a film of the developer contained in the container on a surface thereof being exposed while rotating, a light emitting module for emitting a predetermined amount of light to the surface of the roller where the film is formed, a light-receiving module, installed to detect light emitted from the light emitting module and passing through the film, for transmitting a photodetector signal p corresponding to the amount of received light, a temperature detector for detecting the temperature T of the developer solution contained in the container, a roller driving module for controlling driving of the roller to rotate at a set speed corresponding to the temperature output signal from the temperature detector, and a concentration measuring module for measuring the concentration of the developer, based on the signal output from the light-receiving module.

BRIEF DESCRIPTION OF THE DRAWINGS

A more complete appreciation of the invention, and many of the attendant advantages, thereof, will be readily apparent as the same becomes better understood by reference to the following detailed description when considered in conjunction with the accompanying drawings in which like reference symbols indicate the same or similar components.

DETAILED DESCRIPTION OF THE INVENTION

Figure 1:
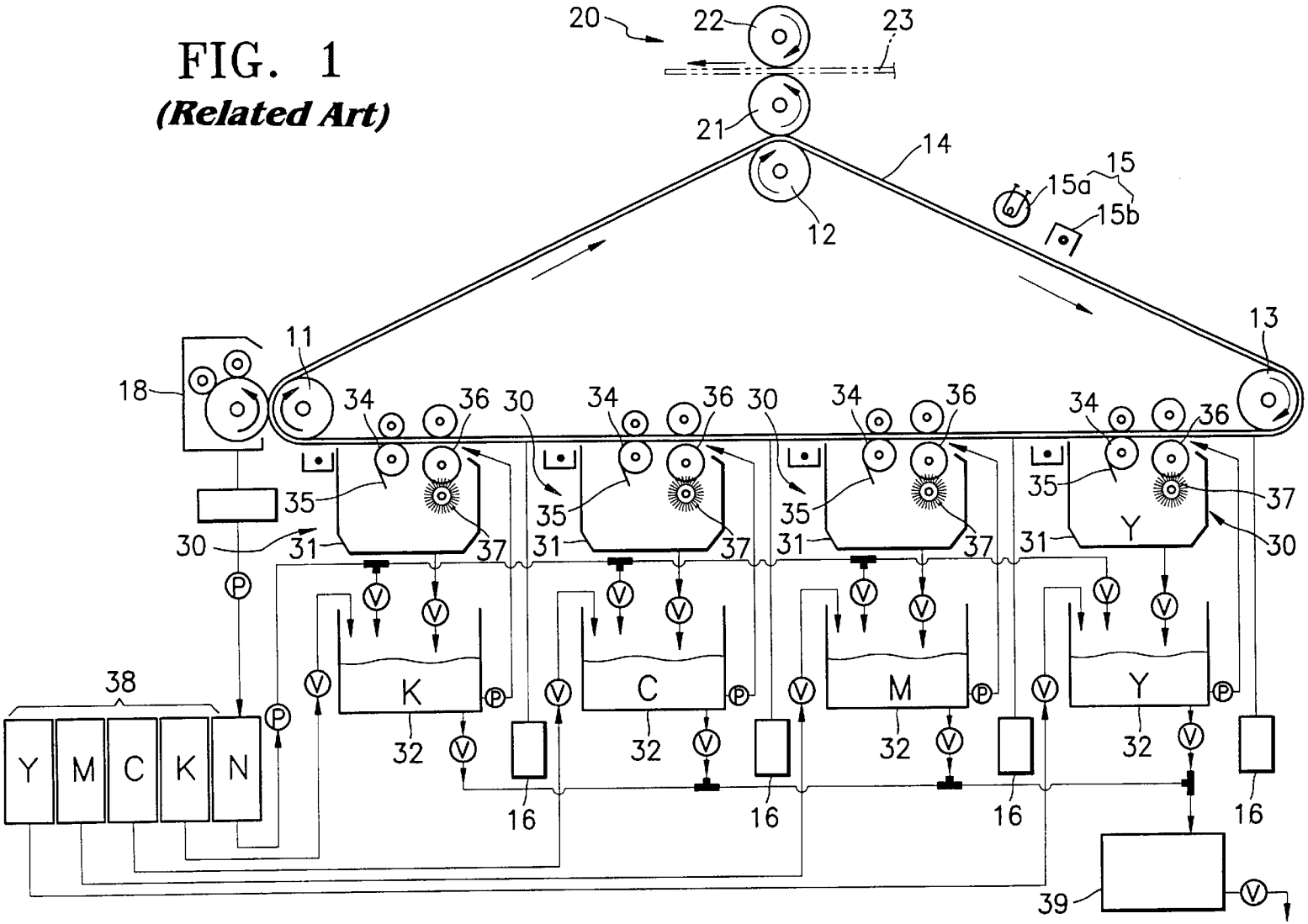
FIG. 1 (Related Art)
FIG. 1 is a view showing the configuration of a general liquid color printer of the related art.

Referring to FIG. 1, a general liquid color image forming apparatus based on the related art includes a photoreceptor web 14 circulating by being supported by rollers 11, 12 and 13, a reset unit 15, laser scanning units 16, development units 30, a drying unit 18, and a transfer unit 20.

Reset unit 15 includes a discharger 15*a* for removing an electrostatic latent image by emitting light to photoreceptor web 14 and a charger 12*b* for charging photoreceptor web 11 to a predetermined electric potential. Reference numeral 39 denotes a waste developer collecting container.

Four laser scanning units 16 scan color information of yellow (Y), magenta (M), cyan (C) and black (K) onto the photoreceptor web 14. Four development units 30 provide developers of yellow (Y), magenta (M), cyan (C) and black (K) to photoreceptor web 14.

Development units 30 include a developer supply container 32 for supplying developer to photoreceptor web 14 and a development reservoir 31 for collecting developer falling from photoreceptor web 14. In development reservoir 31, there are a development roller 36, a brush roller 37 for removing developer adhering to development roller 36, a squeegee roller 34 for separating a liquid carrier component of the developer supplied to photoreceptor web 14 which is not used for forming an image, and a blade 35 for collecting the carrier component flowing down along squeegee roller 34.

Development supply container 32 receives developer solution contained in development reservoir 31, liquid carrier component N (norpor), which is solvent, provided from a developer supply module 38, and toner which is development material or highly concentrated developer. The developer solution contained in developer supply container 32 is driven by a pump P and supplied between the development roller 36 and photoreceptor web 14.

To maintain the quality of an image in the above-described general liquid printer, concentration of the developer solution supplied to photoreceptor web 14, that is, the ratio of a mixture of the toner and the liquid carrier must be appropriately maintained.

Figure 2:
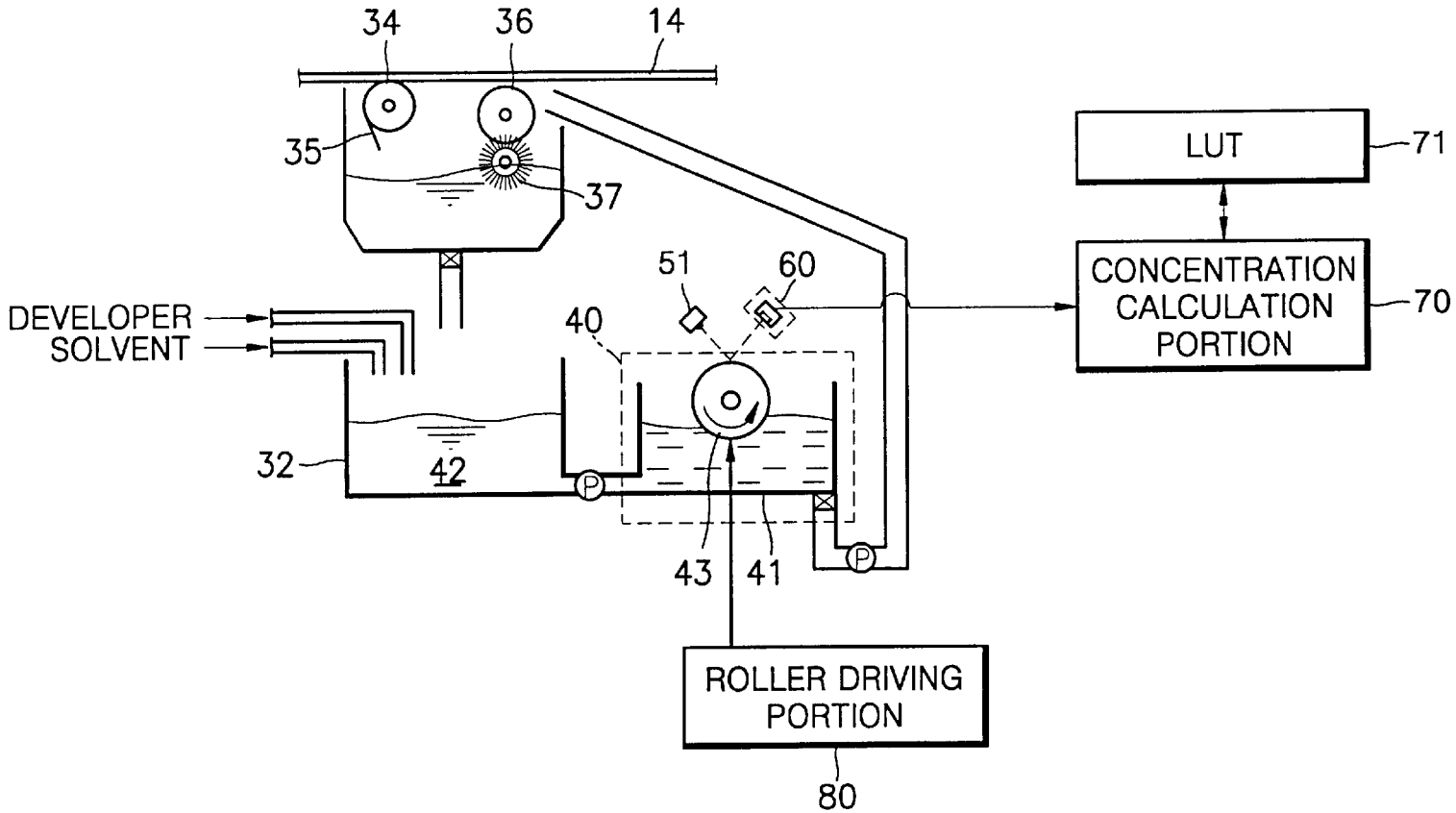
FIG. 2 (Related Art)
FIG. 2 is a view showing an apparatus for measuring the concentration of developer, based on the related art.

Referring to FIG. 2, a developer concentration measuring apparatus based on the related art includes a film forming module 40, a conventional light source 51, a conventional photodetector 60 producing an output voltage signal p, a concentration-calculation means or module 70, a lookup table (LUT) 71, and a roller-driving module 80. The LUT is any convenient memory device, such as an EPROM, EEPROM, flash memory chip, or the like.

Film-forming module 40 includes a container 41 for containing developer solution 42, so that developer solution 42 is formed on a roller 43 as a thin film having an appropriate thickness by roller 43, which is rotatably installed in container 41. Rolle-driving module 80 rotates roller 43 at a constant speed. Photodetector 60 is installed to receive light emitted from light source 51 and reflected by roller 43. Concentration-measurement module or means 70 determines a concentration of the developer corresponding to a signal output voltage p from photodetector 60, utilizing lookup table 71.

Figure 3:
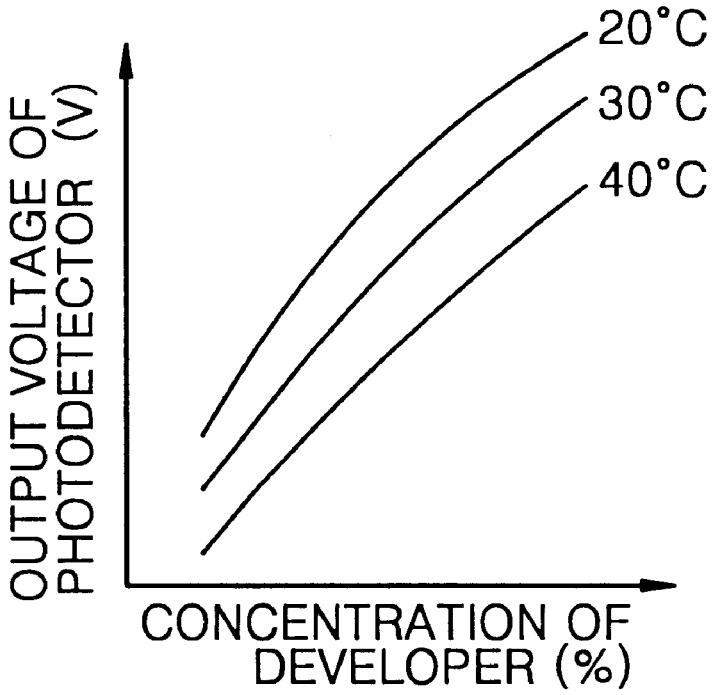
FIG. 3 is a graph showing the change of the signal output from the photodetector of FIG. 2 according to the change of temperature of developer solution.

However, the inventors have found that when the temperature T of developer solution 42 contained in container 41 varies due to change of the temperature of surroundings, the signal output p from photodetector 60 changes. The inventors have found this change occurs because, as the viscosity of developer 42 changes according to the change of the temperature, the thickness of the film formed on roller 43 rotating at a constant speed varies. This effect is graphed in FIG. 3, showing developer solution concentration C as a function of voltage p and temperature T. Thus, the conventional developer solution concentration measuring apparatus has a drawback in that an error is generated in measuring the concentration of developer due to the change of temperature T of developer solution 42.

Figure 4:
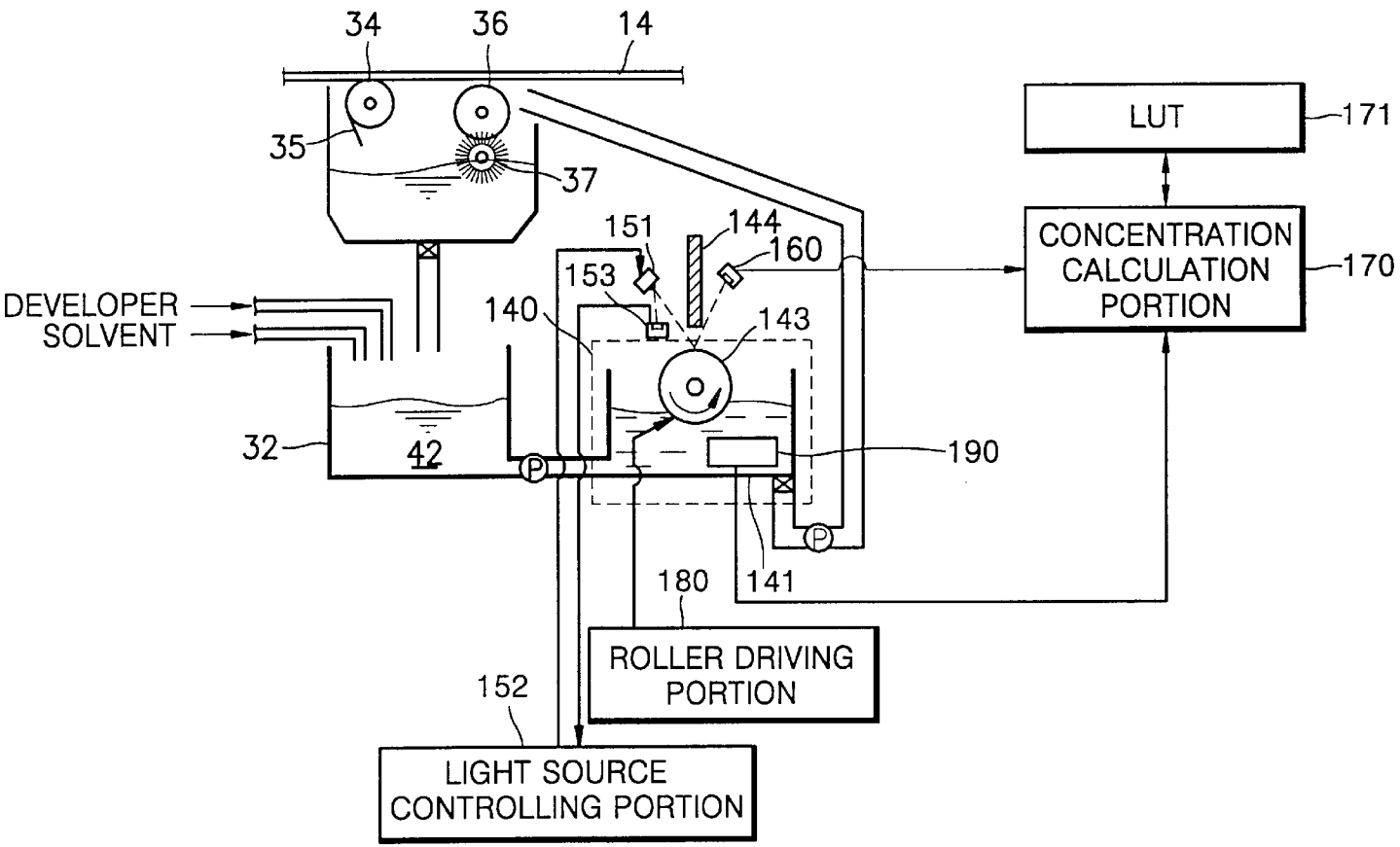
FIG. 4 is a view showing the structure of an apparatus for measuring the concentration of developer according to a first preferred embodiment of the present invention.

Referring to FIG. 4, an apparatus for measuring the concentration of developer solution according to a first preferred embodiment of the present invention includes a film-forming module 140, a light-emitting module, a light-receiving or photodetector module 160, a concentration-calculation means or module 170, a lookup table (LUT) 171, and a roller-driving module 180.

The film forming module 140 includes a container 141 for containing developer solution 42 and a roller 143 rotatably installed in container 141. Container 141 is installed on a path along which developer solution 42 is supplied from developer solution supply container 32 to photoreceptor web 14, so that developer solution 42 can enter and be exhausted (pumped out). The developer solution can enter and be exhausted out of (i.e., pumped out of) container 141 by means of a pump P. Alternatively, developer solution supply container 32 can be used as container 141, as it is, and roller 143 can be installed inside developer supply container 32.

Roller 143 is partially or entirely formed of a material which reflects light. Unlike the above, although not shown, when light-receiving module 160 is installed to receive light emitted from a light source 151 and passing through roller 143, part or all of roller 143 is formed of a transparent material. Roller 143 is driven at a uniform speed set by roller-driving module 180.

The light-emitting module includes a light source 151 installed to be able to emit light toward roller 143, a photodetector 153 for detecting part of the light emitted from light source 151, and a light-source controlling module 152 for controlling the driving of light source 151 using the signal output from photodetector 153, so that a constant amount of light is emitted.

As a light-receiving module 160, a photodetector is installed to receive the light emitted from light source 151 and reflected by roller 143 while passing through the film of roller 143. An inner circuit of light-receiving module 160 is configured to output a voltage signal p corresponding to the amount of received light. Reference numeral 144 denotes a light shielding plate for preventing the light emitted from light source 151 from directly landing on light-receiving module 160.

A temperature detector 190 is installed in container 141 and provides information on the temperature T of developer solution 42. Concentration-measurement means or module 170 measures the concentration of developer solution 42 using the light-receiving signal output p from light-receiving module 60 and the temperature output signal from temperature detector 190, which is representative of temperature T.

Lookup table 171 contains a concentration value of developer corresponding to the light-receiving signal output p from light-receiving module 160 according to the temperature T of developer solution 42 to be tested. Thus, concentration-measurement means or module 170 obtains, from lookup table 171, a concentration value of the developer corresponding to the light-receiving signal output p from light-receiving module 160 and the temperature output signal from temperature detector 190. The concentration-measurement module 170 may also use an alternative means for determining concentration C as a function F(p, T), where p is the photodetector output voltage and T is the temperature of the developer solution as determined by means of temperature detector or sensor 190. This alternative is discussed below.

Figure 5:
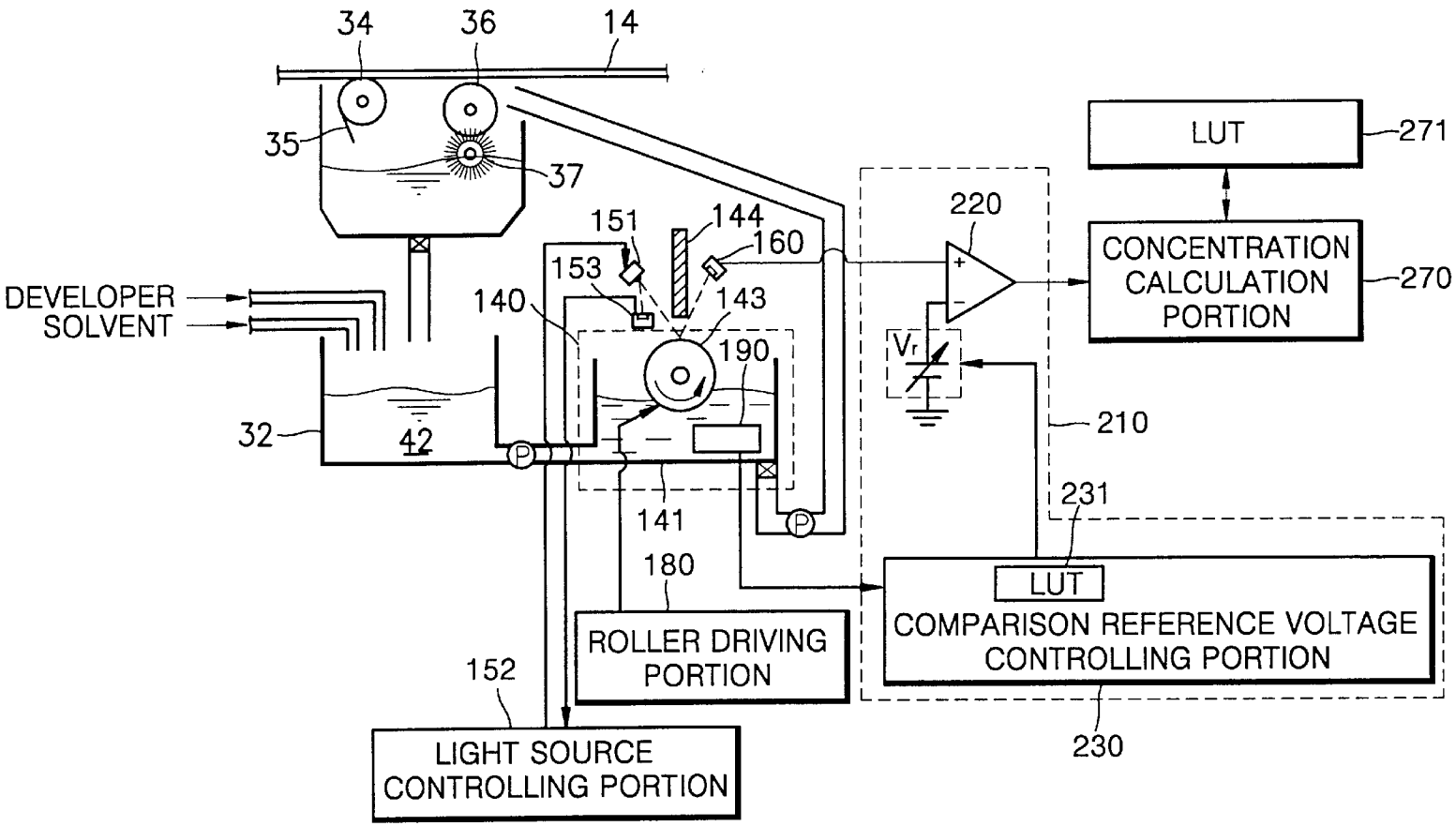
FIG. 5 is a view showing the structure of an apparatus for measuring the concentration of developer according to a second preferred embodiment of the present invention.

Referring to FIG. 5, an apparatus for measuring the concentration of developer solution according to a second preferred embodiment of the present invention includes film forming module 140, the light-emitting module, light-receiving module 160, a light-receiving amount controlling module 210, a C concentration-measurement means or module 270, a lookup table 271, and roller-driving module 180.

Light-receiving amount controlling module 210 includes a comparator 220 for correcting a light-receiving signal output from light-receiving module 160 according to the temperature output signal from temperature detector 190, which is representative of temperature T of the developer solution, and for outputting the corrected light-receiving signal to concentration-measurement means or module 270, and a comparison reference voltage controlling module 230. Comparator 220 outputs a signal corresponding to the difference between the signal output p from light-receiving module 160 and a comparison reference voltage Vr.

Comparison reference voltage controlling module 230 variably controls the comparison reference voltage Vr of comparator 220 according to the temperature output signal from temperature detector 190. Comparison reference voltage Vr values applicable for each temperature are recorded in a lookup table 231 provided in comparison reference voltage controlling module 230, or an alternative means is used, as discussed below. Thus, comparison reference voltage controlling module 230 reads the temperature output signal from temperature detector 190, reads a comparison reference voltage value corresponding to the read information on the temperature, from lookup table 231, and controls comparison reference voltage Vr so as to maintain read comparison reference voltage value. The comparison reference voltage value is set to compensate for a variation in the amount of received light which is output from light-receiving module 160 according to the change in the temperature, so that the compensated light-receiving signal is output from comparison module 220.

Concentration values corresponding to the light-receiving signal output from comparison module 220 are recorded in lookup table 271 which is used by concentration-measurement module 270. Concentration-measurement means or module 270 determines the concentration value of the developer solution corresponding to the signal output from comparison module 220, with reference to lookup table 271.

Figure 6:
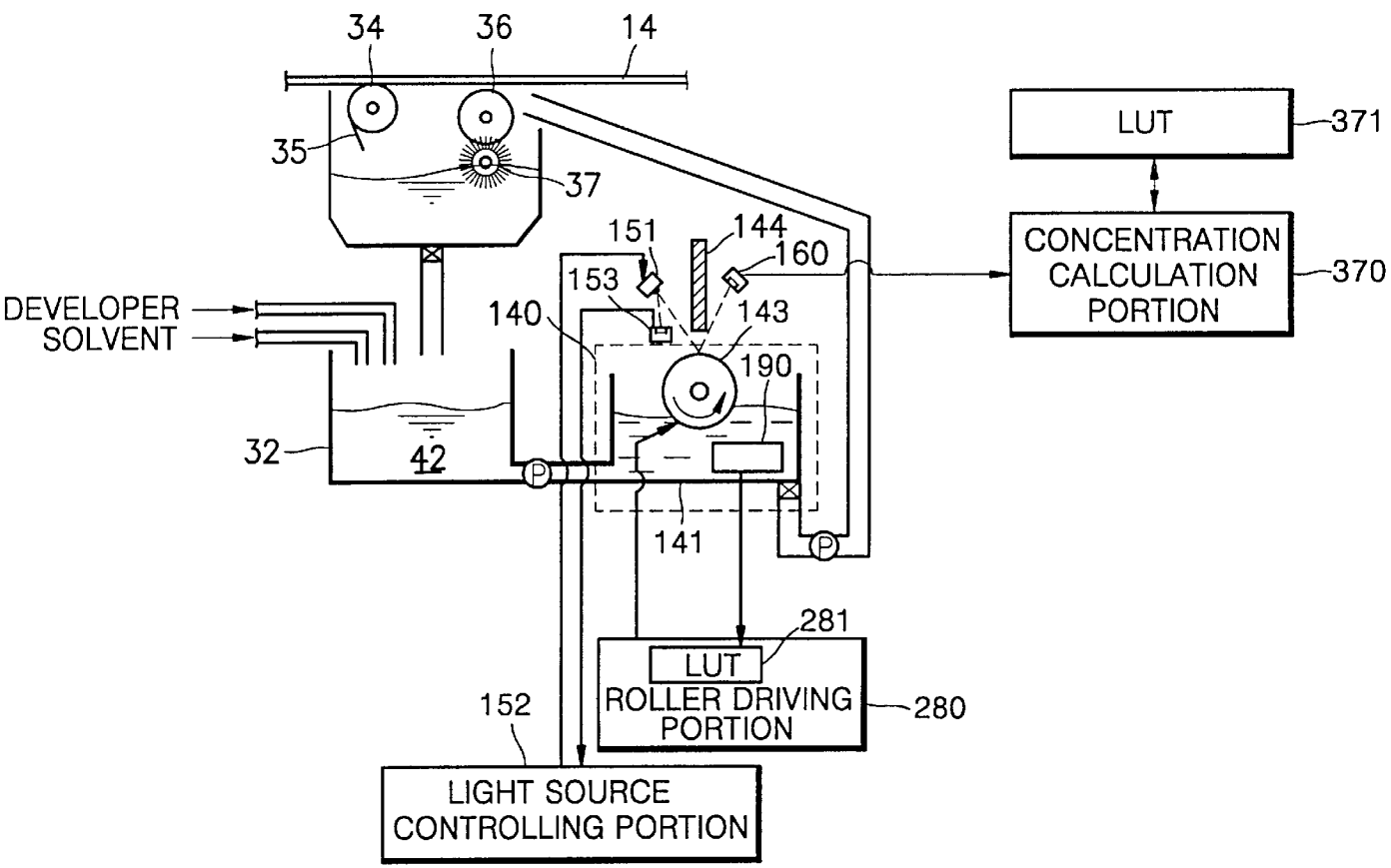
FIG. 6 is a view showing the structure of an apparatus for measuring the concentration of developer according to a third preferred embodiment of the present invention.

Referring to FIG. 6, an apparatus for measuring the concentration of the developer solution according to a third preferred embodiment of the present invention includes film-forming module 140, a light-emitting module, light-receiving module 160, a concentration-measurement means or module 370, a lookup table 371, and a roller-driving module 280.

Roller-driving module 280 controls roller 143 to maintain a rotation speed set corresponding to information on the temperature T provided from temperature detector 190. Rotation speeds applicable for each temperature to compensate for the change in the amount of light input to light-receiving module 160 (and thus output signal p) due to change in temperature are recorded in a lookup table 281 provided in the roller driving module 280, or an alternative means is used to develop the appropriate functional relationship F (p, T), as discussed below.

Concentration values of developer corresponding to the light-receiving signal output voltage p from light-receiving module 160 are recorded in lookup table 371. Concentration-measurement module 370 determines a concentration value C of developer corresponding to the signal output from light-receiving module 160, with reference to lookup table 371.

Other means may be used to develop the functional relationship F(p, T) for determining a concentration C of the developer solution. As indicated above, C=F(p, T), where F is such that C, as calculated, increases when signal p increases and C also increases if the signal representative of T increases, where p is the voltage output from the photodetector and T is a temperature determined from the temperature detector or sensor output signal. As shown in FIG. 3, $C \approx C_o + ap + bT$. Concentration C may also be represented by other ascending joint functions of p and T, as deemed appropriate based on empirical data. For example, $C = C_0(T - T)e\ k(p - p_0)$. Instead of using a lookup table, as described above, C may be calculated by a programmed microprocessor, using the function C=F(p, T) where F is determined as described hereinabove. Using a programmed microprocessor can have the advantage of permitting calculations to be based on "finer grain" readings of temperature and received light than may be readily available from a lookup table device.

As described above, with the developer concentration measuring apparatus of a liquid printer according to the present invention, by obtaining information on the temperature of developer and measuring the concentration of the developer appropriate to the obtained temperature information, generation of concentration measurement errors is lowered.

What is claimed is:

1. In a measuring apparatus for measuring developer solution concentration in a liquid printer, said printer comprising:

a photoreceptor web supported on rollers, said rollers circulating said photoreceptor web; and a developer container for containing a developer solution supplied to the photoreceptor web; and said measuring apparatus comprising:

a sampling roller located within the developer container, said sampling roller partially submerged in the developer solution within the developer container, said sampling roller rotating to form a film of developer solution on an exposed surface of the roller;

a light source illuminating said film of developer solution;

a photodetector receiving light reflected from the light source via the roller surface from said film of developer solution and producing a photodetector output signal p representative of a current developer solution concentration in said developer solution;

a temperature sensor detecting a current temperature T of the developer solution in the developer container, said sensor providing a temperature output signal corresponding to the current temperature T of the developer solution; and an electronic concentration-measurement unit determining a concentration of the developer solution as a function F(p, T) of both the current photodetector output signal and the current temperature output signal.

2. The apparatus of claim 1, wherein the concentration-measuring unit comprises:

a lookup table in which are stored concentration values of the developer solution corresponding to a plurality of light-receiving output signals p from the light-receiving module and a plurality of temperatures T of the developer solution; and a concentration-calculation unit obtaining, from the lookup table, a current concentration value corresponding to the current temperature output signal from the temperature detector and the current light-receiving signal output from the light-receiving module.

3. The apparatus of claim 1, wherein the concentration measuring unit comprises:

a light-receiving amount controlling module correcting the light-receiving signal output from the light-receiving module according to the temperature output signal from the temperature sensor and providing the corrected signal as an output;

a lookup table in which concentration values corresponding to the output signal from the light-receiving amount controlling module are recorded; and a concentration-calculation module obtaining from the lookup table a concentration value corresponding to the output signal from the light-receiving amount controlling module.

4. The apparatus of claim 3, wherein the light-receiving amount controlling module comprises:

a comparator comparing the signal output from the light-receiving module with a set comparison reference signal and providing a comparison result signal as output;

a comparison reference voltage controlling module controlling the comparison reference signal so that a comparison reference signal set to correspond to the temperature output signal from the temperature sensor is applied to the comparator.

5. The apparatus of claim 1, wherein the concentration-measuring unit comprises a microprocessor programmed to determine the current developer solution concentration C as a function F of the current photodetector output signal p and the current developer solution temperature T, such that C=F(p, T).

6. The apparatus of claim 5, wherein said function F is an empirically determined ascending function of both p and T.

7. The apparatus of claim 1, wherein the light-receiving module is installed to detect light passing through the surface of the roller and the film.

8. The apparatus of claim 1, wherein the light-receiving module is installed to detect light reflected by the surface of the roller and passing through the film.

9. A developer concentration measuring apparatus comprising:

a container into which a developer solution supplied to a photoreceptor web enters and from which the solution is then exhausted;

a roller rotatably installed in the container for forming a film of the developer solution contained in the container on a surface of the roller which is exposed while the roller is rotating;

a light-emitting module emitting a predetermined amount of light to the surface of the roller where the film is formed;

a light-receiving module detecting light emitted from the light emitting module and passing through the film, whereby a signal p corresponding to the amount of received light is provided;

a temperature detector for detecting a temperature T of the developer solution contained in the container, whereby a temperature output signal is provided;

a roller-driving module driving the roller to rotate at a predetermined speed corresponding to the temperature output signal from the temperature detector; and a concentration-measuring unit determining the concentration of the developer solution based on the signal output from the light-receiving module.

10. The apparatus of claim 9, wherein the concentration measuring unit comprises:

a lookup table in which concentration values corresponding to the signal output p from the light-receiving module are recorded; and a concentration-calculation module for obtaining a concentration value corresponding to the signal output p from the light-receiving module from the lookup table.

11. The apparatus of claim 9, wherein the concentration-measuring unit comprises a microprocessor programmed to determine the developer solution concentration C as a function F of photodetector output signal p and the developer solution temperature T, where C=F(p, T).

12. The apparatus of claim 9, wherein said function F is an empirically determined ascending function of both p and T.

13. The apparatus of claim 9, wherein the light-receiving module is installed to detect light passing through the surface of the roller and the film.

14. The apparatus of claim 9, wherein the light-receiving module is installed to detect light reflected by the surface of the roller and passing through the film.

15. A method of preventing generation in a developer concentration measuring apparatus of errors due to changes of developer temperature, said method comprising the steps of:

sampling light derived from a developer solution to provide a photodetector output signal p;

sampling temperature T of the developer solution to provide a signal representative of T; and determining a concentration C of the developer solution as a joint function F(p, T) of p and T.

16. The method of claim 15, wherein values of F(p, T) are stored in a lookup table so that C can be determined from the lookup table using p and T as input parameters.

17. The method of claim 15, wherein a programmed microprocessor determines C as a function of p and T by solving C=F(p, T) for input values of p and T.

18. A method of measuring a current concentration C of a developer in a liquid printer, said method comprising the steps of:

rotating a sampling roller that is partially submerged in a developer solution, to develop a film of developer solution on an exposed surface of the roller;

illuminating said film of developer solution with a light source;

receiving at a photodetector light reflected from the light source via the film of developer solution on the roller surface, to produce a photodetector output signal p representative of a current developer solution concentration in said developer solution;

providing a temperature sensor for detecting a current temperature T of the developer solution in the developer container, said temperature sensor provides a temperature output signal corresponding to the current temperature T of the developer solution; and determining with an improved electronic concentration-measurement unit the concentration C of the developer solution as a function F(p, T) of both the current photodetector output signal and the current temperature output signal, where C=F(p, T).

19. The method of claim 18, wherein F(p, T) is such that F increases with increases in p and F increases with increases in T.

20. The method of claim 18, wherein values of F(p, T) are stored in a lookup table so that C can be determined from the lookup table using p and T as input parameters.

21. The method of claim 18, wherein a programmed microprocessor determines C as a function of p and T by solving C=F(p, T) for input values of p and T.

* * * * *